United States Patent [19]
de Jong et al.
[11] 4,186,665
[45] Feb. 5, 1980

[54] LOCOMOTIVE ENGINE HOUSING ARRANGEMENT

[75] Inventors: Hendrikus de Jong, Castricum; Joseph A. Welboren, Heemskerk, both of Netherlands

[73] Assignee: Hoogovens Ijmuiden, B. V., Ijmuiden, Netherlands

[21] Appl. No.: 847,104

[22] Filed: Oct. 31, 1977

[30] Foreign Application Priority Data

Nov. 9, 1976 [NL] Netherlands ..... 7612405

[51] Int. Cl.[2] ..... B61C 5/00; B61C 17/04; B61D 39/00; B61D 49/00

[52] U.S. Cl. ..... 105/456; 105/26 R; 105/62 R; 105/335; 105/379; 105/452; 105/457; 105/460

[58] Field of Search ..... 105/26 R, 49, 335, 456, 105/62 R, 379, 452, 460; 180/14 R, 89.17, 89.18, 69 R, 89, 17

[56] References Cited

U.S. PATENT DOCUMENTS

| | | | |
|---|---|---|---|
| 598,842 | 2/1898 | Barton | 105/335 |
| 2,266,769 | 12/1941 | Kramer | 180/89.17 X |
| 2,370,237 | 2/1945 | Essl | 105/26 R |
| 2,407,506 | 9/1946 | Milheizler | 105/62 R |
| 3,098,456 | 7/1963 | Elsner | 105/379 |
| 3,670,664 | 6/1972 | Thornton | 105/379 |
| 4,067,264 | 1/1978 | Ensink | 105/456 |
| 4,077,535 | 3/1978 | Oriol | 180/14 R X |

FOREIGN PATENT DOCUMENTS

| | | | |
|---|---|---|---|
| 1088527 | 9/1960 | Fed. Rep. of Germany | 105/401 |
| 1215907 | 4/1960 | France | 105/401 |
| 7501080 | 8/1976 | Netherlands | 105/456 |
| 886205 | 1/1962 | United Kingdom | 105/62 R |

OTHER PUBLICATIONS

Glasers Annalen, Nov. 1961, vol. 85, No. 11; p. 363.

*Primary Examiner*—Trygve M. Blix
*Assistant Examiner*—Howard Beltran
*Attorney, Agent, or Firm*—Stevens, Davis, Miller & Mosher

[57] ABSTRACT

A diesel-engined rail shunting locomotive is provided which combines a very high level of noise insulation with excellent accessibility to the engine and associated apparatus. The locomotive is adapted for remote control by radio, and also has at least one cab for the operator. The engine and associated apparatus are covered by a noise insulating rectangular box-shaped hood which is liftable as a single unit by means of power-operated lifting means provided on the locomotive. The lifting means may be screw jacks located in the four corners of the hood. The cab has an end wall slightly spaced from adjacent the end wall of the hood, to simplify construction and improve sound insulation.

7 Claims, 13 Drawing Figures

FIG. 9
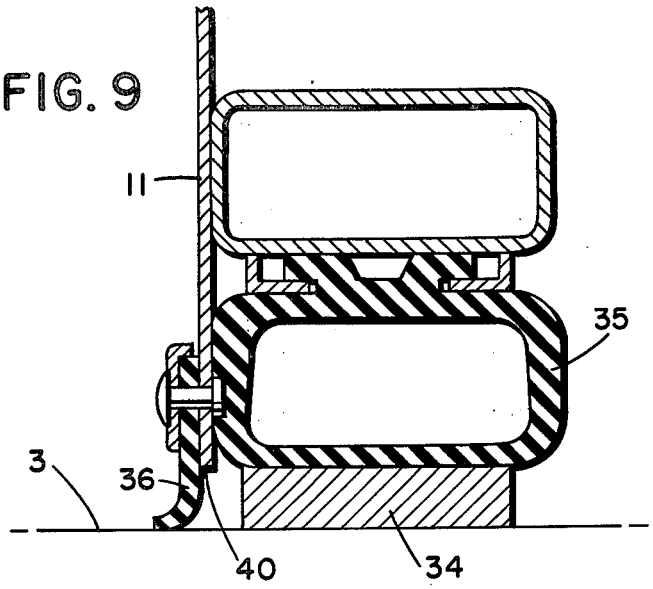
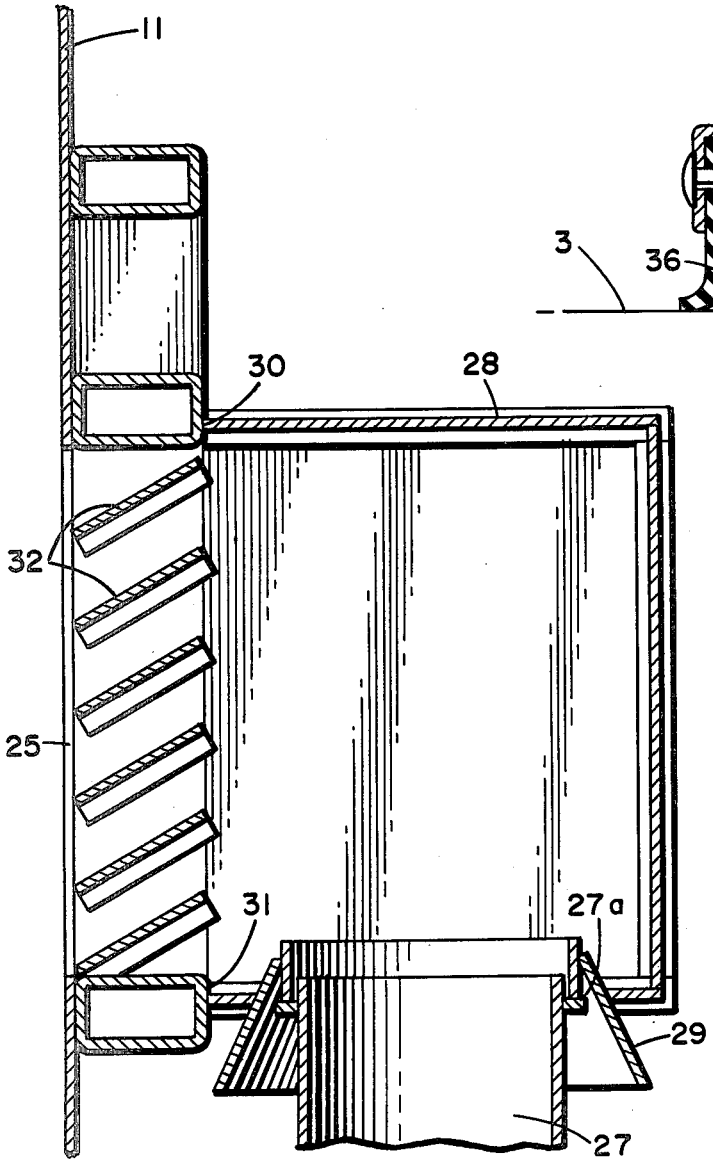
FIG. 8
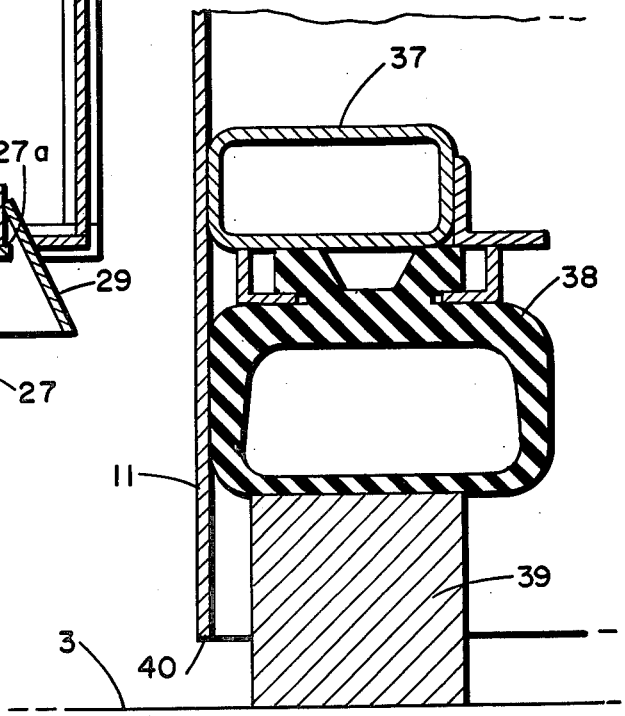
FIG. 10

LOCOMOTIVE ENGINE HOUSING ARRANGEMENT

BACKGROUND OF THE INVENTION

1. Field of the Invention

This invention relates to railway locomotives, more particularly shunting locomotives which may be adapted for remote control by radio and particularly provides improvements in noise insulation and in access for repair and maintenance.

2. Description of the Prior Art

It is nowadays especially important that shunting locomotives should be quiet, since they move only slowly and often remain stationary for some time in one place. A high level of noise insulation of the engine however tends to reduce the ease of access for repair and maintenance, which is a serious disadvantage when labour costs are high and when quick maintenance is required. Conventional shunting locomotives have one or more coverings or casings for the engine and associated equipment in the form of a fixed frame on which removable or slidable panels and/or hinged doors are mounted. Generally noise insulation is poor, and access is imperfect either because the panels must be removed and lain on the ground beside the locomotive or because slidable panels and doors when open cover each other or may obstruct the gangway beside the engine casing. An example of such a casing having a frame and hinged doors and slidable panels is shown in U.S. Pat. No. 2,407,506.

An alternative approach to the same problem, which has not been widely adopted, is shown in U.S. Pat. No. 2,370,237. This locomotive has two hoods which are telescopically slidable one within the other. Access is improved, but only to one half of the equipment at any time.

A different problem of access, though again in a railway context, is the subject of U.S. Pat. Nos. 3,098,456 and 3,670,664, which show railway wagons (specifically a box-car and a flat-car) which have housings or coverings for the goods being carried which are liftable bodily from the floor of the wagon to allow loading and unloading. U.S. Pat. No. 3,098,456 in particular shows a rectangular envelope body with corner post housings protruding outwardly at each corner. Vertically disposed in these housings are lifting screws, which are rotated in common to lift the body by means of bevel gears, two rods extending longitudinally of the wagon and a chain connecting the rods extending across the wagon.

SUMMARY OF THE INVENTION

The object of this invention is to provide a railway locomotive, particularly a shunting locomotive, having good noise insulation combined with good access to the engine and associated equipment.

According to the invention there is provided a railway locomotive having at least one cab for an operator, an engine and associated apparatus, a unitary hood having a roof, two side walls and two end walls enclosing and covering the said engine and associated apparatus, and power-operated lifting means for lifting the said hood upwardly as a unit to provide access to the said engine and associated apparatus, the said side and end walls of the hood having sound-insulating material on their inner faces and the cab having a wall adjacent to and spaced from one of the said end walls of the hood in the closed position thereof.

With this arrangement it is possible to achieve the desired level of sound insulation and yet to have good access. The box-like shape of the insulation-lined hood totally encloses the engine compartment and confines the sound of the engine very well. The box-like shape of the hood is also simple and sturdy in construction, and enables a resilient seal extending all around the hood at one level to engage the platform supporting the engine. This platform is preferably sound-insulated beneath the engine.

The cab wall adjacent the end wall of the hood preferably also has sound insulation. The arrangement of these two walls with a small gap between provides particularly good sound insulation between the cab and the engine compartment, and makes them two separate structures. Delicate control equipment, e.g. for radio remote-control, can be housed in the cab. This arrangement is significantly different from conventional locomotives, where the frame of the engine housing is secured to the cab. Separate housings for engine and other parts, e.g. the compressor, are unnecessary.

On the other hand, the raising of the hood permits excellent, unobstructed access to the engine, and associated apparatus. Quick and efficient maintenance is obtainable, and costs are minimised.

The lifting means for the hood may be any suitable linearly operative mechanism, such as pulleys and ropes, pneumatic cylinders or hydraulic cylinders. It is most preferred however if the hood is rectangular in plan and said lifting means comprises four vertical screw jacks located inside the hood respectively adjacent the four corners thereof.

In this case, the desired uniform lifting of the hood at all four corners may be achieved if the two said screw jacks at each longitudinal end of the hood are coupled by a common drive shaft extending along the short side of the hood, each said drive shaft being driven by a synchronous alternating-current motor, whereby when driven from a common suitable current supply, the two drive motors drive all four screw jacks at the same speed.

To achieve good sealing of the hood to the platform, preferably the lifting means for the hood is adapted to exert an extra closing force on said resilient seal, additional to the weight of the hood, when the hood is in its lowered position.

At its inside, the engine hood is provided with a sound-insulating layer. Preferably the closing surfaces for the inlet and outlet openings in the hood for combustion air, cooling air etc. are provided with seals to the hood. Preferably the closing surfaces of the air inlet opening or openings located in the side wall or walls of the engine hood are sealed obliquely.

The number of doors in the engine hood should be limited to a minimum. Preferably in one or both of the long side walls of the engine hood an inspection door likewise insulated at the inside is provided. Through this door quick maintenance is possible and the supply of oil, water and fuel may be arranged to take place.

BRIEF DESCRIPTION OF THE DRAWINGS

An embodiment of the invention will now be described by way of example only with reference to the accompanying drawings, in which:

FIG. 8 is a sectional view showing the seal of the side inlet opening for combustion air and taken along line 8—8 of FIG. 5;

FIG. 9 is a sectional view showing the seal along the bottom of the hood against the platform, taken along the line 9—9 of FIG. 5;

FIG. 10 is a sectional view showing the seal at the bottom of the hood on a short side thereof, taken along the line 10—10 of FIG. 4;

DESCRIPTION OF THE PREFERRED EMBODIMENT

Figure 1:
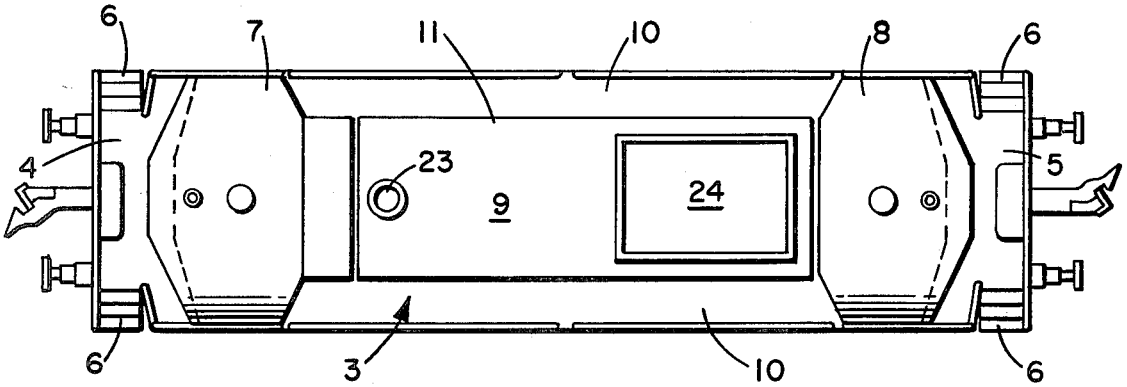
FIG. 1 is a top plan view of the locomotive embodying the invention.
Figure 2:
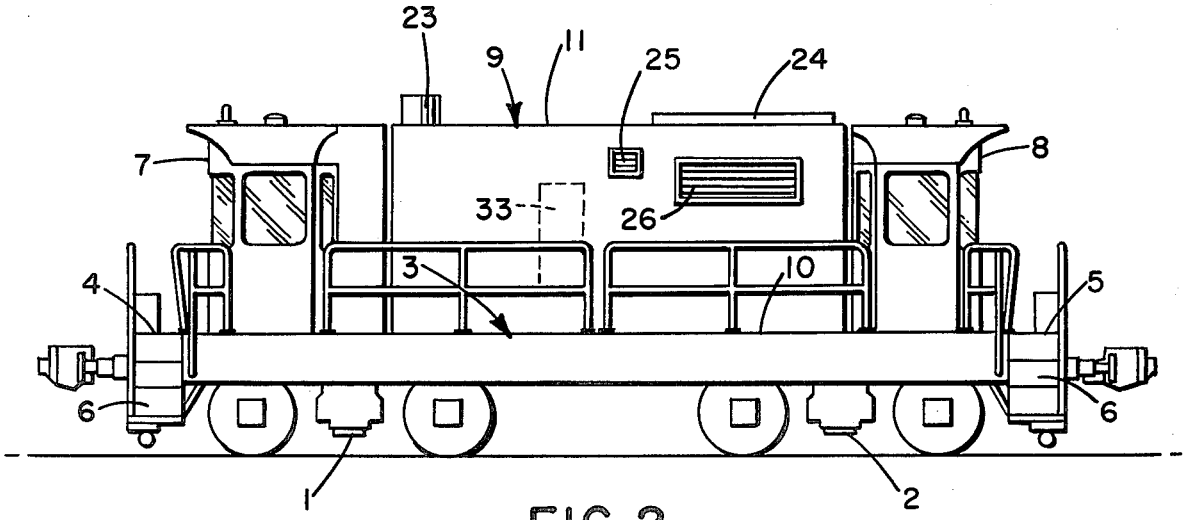
FIG. 2 is a side elevational view of the locomotive of FIG. 1.
Figure 3:
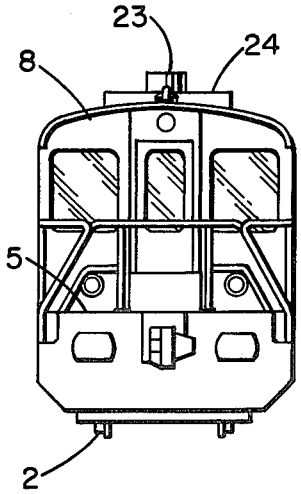
FIG. 3 is an end elevational view, partially in section, of the locomotive of FIG. 1.

The locomotive shown in FIGS. 1 to 3 has two four-wheeled bogies 1 and 2 whereby it runs on rails. The locomotive has a platform 3 that forms the walking level for the operator. At the front and rear ends the platform 3 forms open crossways 4 and 5, at each side of which are steps 6 for climbing on and off and for standing. At the front and the rear, shelter cabs 7 and 8 for the operator are provided.

Between the two cabs 7 and 8 is the engine compartment 9 in which the diesel engine, cooling installation, compressor etc. are installed. At both sides of the engine compartment 9 there is a walkway 10, which is provided with a handrail. The engine compartment is covered by a box-shaped liftable engine hood or enclosure 11 of rectangular plan with two long side walls and two shorter end walls.

Figure 4:
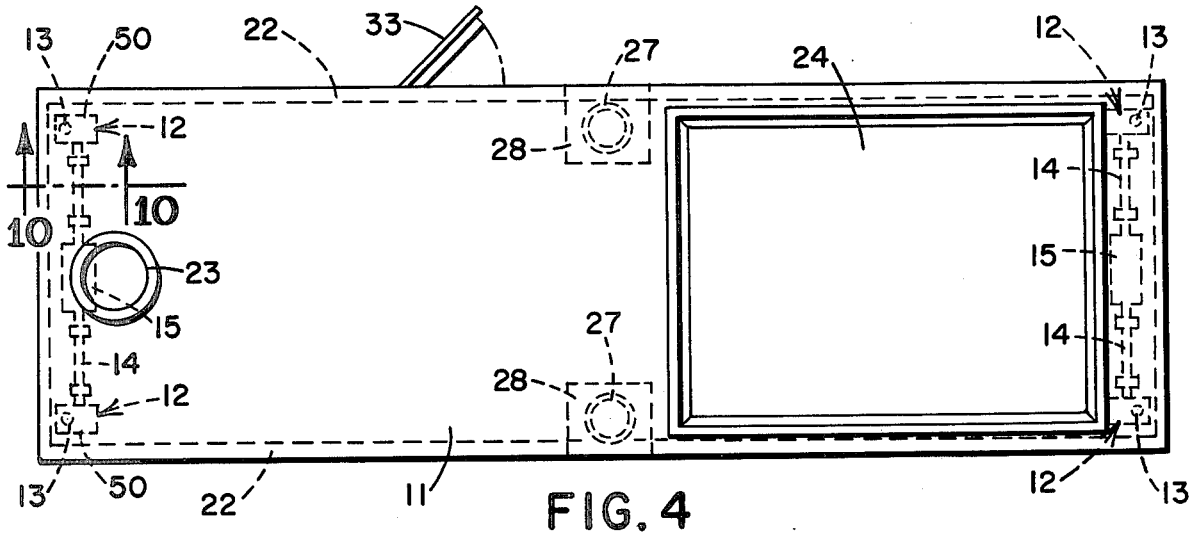
FIG. 4 is a top plan view of the engine hood of the locomotive of FIG. 1.
Figure 5:
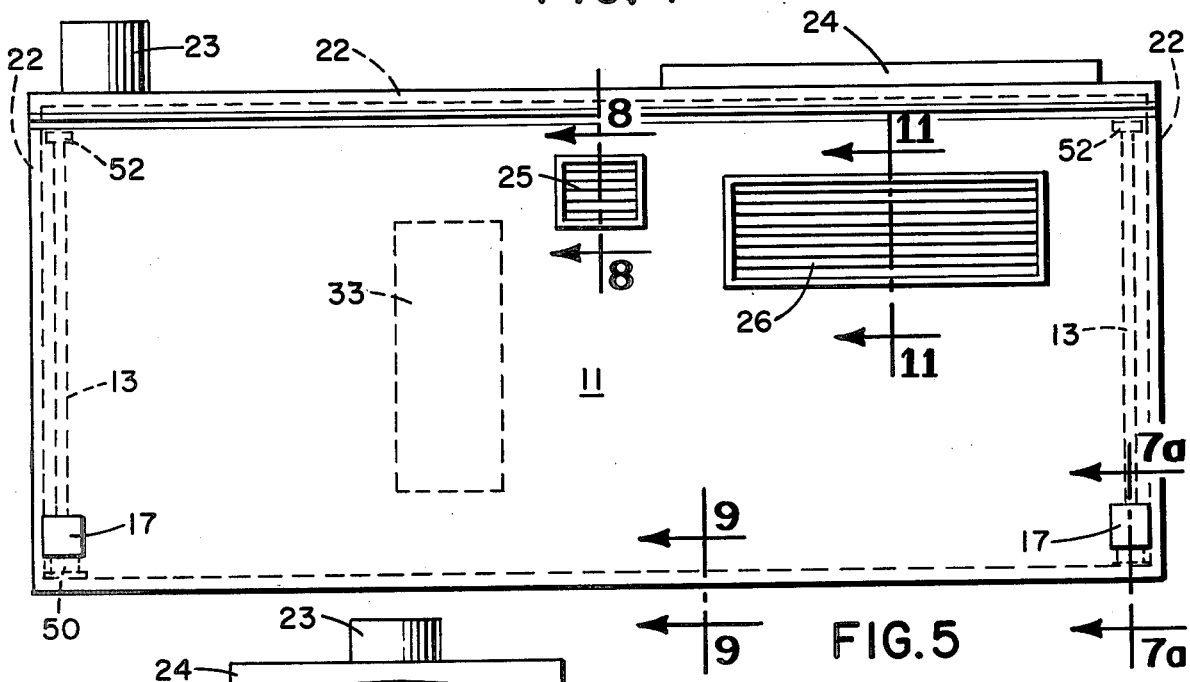
FIG. 5 is a side elevational view of the hood of FIG. 4.
Figure 6:
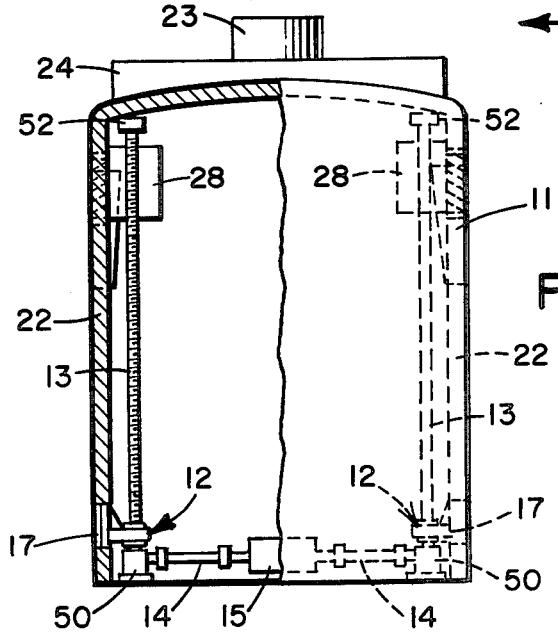
FIG. 6 is a front elevational view of the hood of FIG. 4.

As best seen in FIGS. 4 to 6, the engine hood or enclosure 11 has the shape of a rectangular box, which is entirely open at the under side and when closed encloses the engine compartment as a cover. As is clearly seen in FIGS. 1 and 2, each end wall of the hood or enclosure 11 is opposed to and slightly spaced from an adjacent wall of the cab at that end of the locomotive. The left-hand cab 7 has a compartment adjacent the hood or enclosure 11 which houses delicate control equipment, such as the radio receiver for the remote control of the locomotive.

For lifting the engine hood or enclosure 11 easily during checking and repair in the maintenance shop, a screw jack mechanism 12 is located in each of the four corners of the hood or enclosure, inside the hood or enclosure. Vertical screws 13 of these jacks are supported rotatably on the platform 3 (see FIG. 6) and via bevel gearing, in gear boxes 50, are coupled in pairs by horizontal shafts 14 extending along the short sides of the engine hood or enclosure. In each of these shafts 14 a synchronous alternating-current motor 15 mounted on the platform 3 is included to provide the drive. The upper ends of screws 13 are rotatably supported in bearings 52 secured to hood or enclosure 11.

Figure 7A:
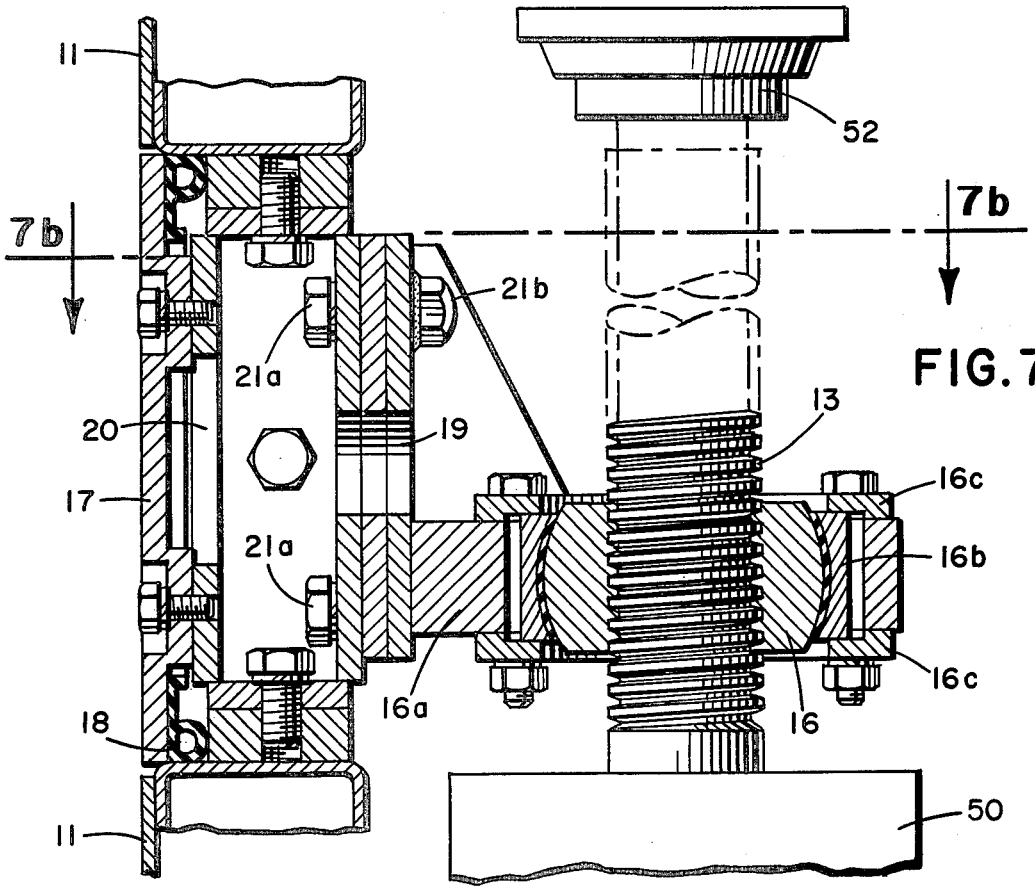
FIG. 7*a* is a sectional view showing the connection of the engine hood of FIG. 4 to a lifting spindle, taken along the line 7*a*—7*a* of FIG. 5.
Figure 7B:
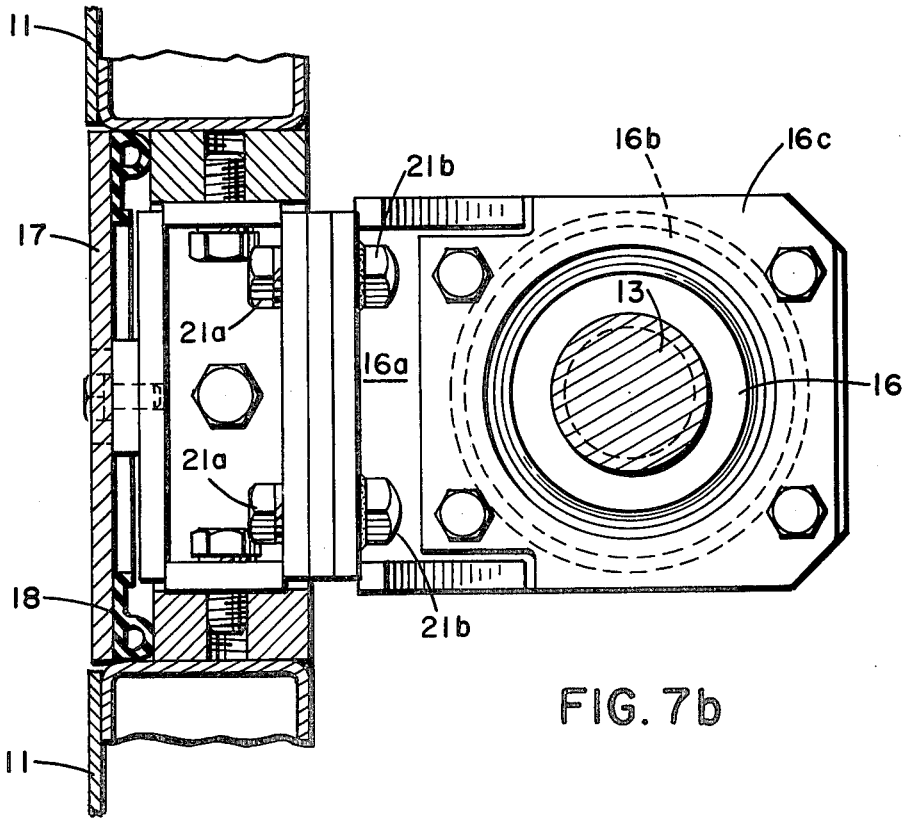
FIG. 7*b* is a top view, partially in section, of the parts shown in FIG. 7*a* and taken along the line 7*b*—7*b* of FIG. 7*a;*

The engine hood or enclosure 11 is supported in each of the four corners in the manner shown in FIGS. 7*a* and 7*b*. A nut 16 mounted on the screws 13 has a spherical outer surface and is incorporated in bearing block 16*a* by means of a movable element 16*b*. Movable element 16*b* is slideably held between plates 16*c* which are bolted to bearing block 16*a*. Self-centering adjustment of the nut 16 is thus obtained. Satisfactory operation of the lifting mechanism is thus assured even if there are small deviations in construction or if small deformation should occur later. The block 16*a* is connected to the engine hood or enclosure 11 as indicated by a bolted connection located in an aperture in the hood or enclosure. The connection is provided with a centering hole 19 and an inspection hole 20, which is closed at the outside of the engine hood or enclosure by a hatch 17 which has a peripheral seal 18.

For the benefit of the lifting mechanism the engine hood or enclosure 11 is constructed robustly and has a rigid form. If necessary, the engine hood or enclosure 11 can be completely removed by means of a crane by loosening the bolts 21*a* shown in FIGS. 7*a* and 7*b*, for example, for a major maintenance service. The cap nuts 21*b* are welded onto the block 16*a*.

All over its inner wall face, except for the inlet and outlet openings for the engine and the cooling installation, the engine hood or enclosure 11 is provided with a noise insulating layer, which is diagrammatically indicated by numeral 22 in FIGS. 4–6.

In the hood or enclosure 11, there is an exhaust opening 23 for the exhaust gases of the diesel engine and an outlet opening 24 for the cooling installation. In one of the long side walls of the rectangular engine hood or enclosure there is an air inlet opening 25 for the engine and an air inlet openings 26 for the cooling installation.

The sealing of the air inlet for the diesel engine is shown in more detail in FIG. 8. In the lowered position of the engine hood or enclosure, above the air inlet tube 27 there is a substantially cubical box 28 which is connected at 30 and 31 onto the engine hood or enclosure 11 and is also provided with sound insulation. Opening into the bottom of this box 28 there is a funnel 29 which connects into the inlet tube 27 by means of a seal 27*a*. The space 28 is open towards the exterior through opening 25 in which oblique blinds or baffles 32 are placed to prevent the entrance of rainwater, etc. as much as possible.

In the other of the long side walls of the engine hood or enclosure 11 there is an inspection door 33 which also has noise insulation on the inside. This door swings open outwardly and, because it can swing through about 180 degrees, can be fixed in the open position against the wall of the engine hood or enclosure, in order to prevent it slamming shut in the wind.

All around the bottom of the engine hood or enclosure 11, there is provided a resilient gasket which seals the hood or enclosure to the platform 3. This is shown in FIGS. 9 and 10. On the long sides of the engine hood or enclosure (FIG. 9) a sill 34 is mounted on platform 3, and adjacent to the lower edge of the engine hood or enclosure beneath the lowermost beam thereof there is a resilient tubular sealing gasket 35 which engages the sill 34 when the hood or enclosure is closed. On the outside of the lower edge of the hood or enclosure, there is also a resilient downwardly extending flange 36, which engages the platform 3.

On the short sides of the hood or enclosure, the sealing of the hood or enclosure to the platform 3 (FIG. 10) is achieved by another gasket 38 of resilient material located beneath the lowest beam 37 of the engine hood or enclosure. When the engine hood or enclosure is lowered this gasket rests on a higher sill 39 welded onto the platform 3.

When the hood or enclosure 11 is lowered to a closed position by the two motors 15, an extra closing force is exerted on the seals 35, 34 and 38,39 greater than the weight of the engine hood or enclosure alone. This force is applied by the motors 15 and is maintained by the self-locking effect of the screws 13. This is possible, because—as FIGS. 9 and 10 show—the bottom edge 40 of the engine hood or enclosure does not abut directly against the platform 3 in the closed position.

Figure 11:
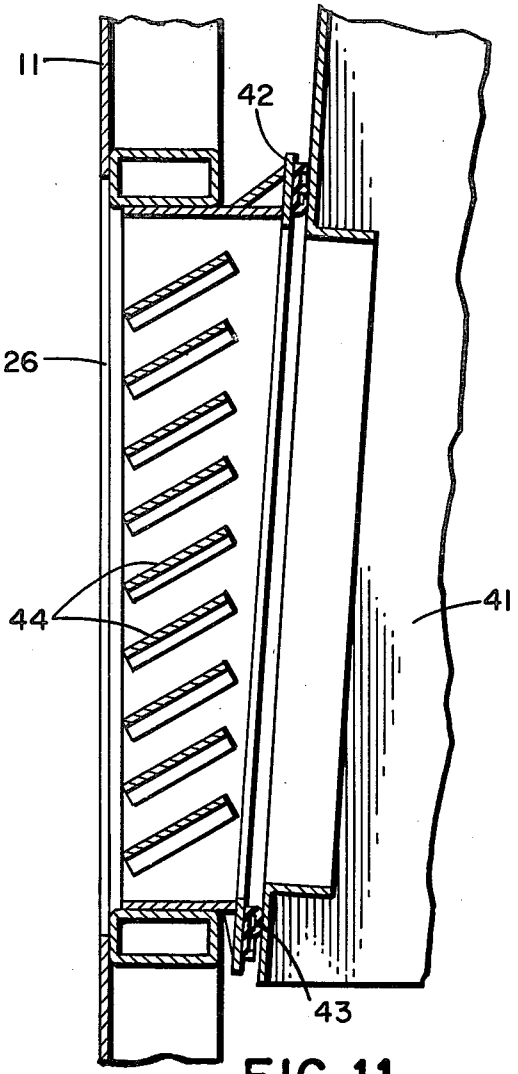
FIG. 11 is a sectional view showing the seal of another side inlet for cooling air, taken along the line 11—11 of FIG. 5.

FIG. 11 indicates how the sealing of the inlet opening 26 leading to an inlet duct 41 of the cooling installation is achieved in the long side wall of the engine hood or enclosure 11. In the opening 26 of the engine hood or enclosure 11 there is mounted a frame 42 which has an internal flange carrying a seal 43 which in the lowered position of the hood or enclosure engages a peripheral flange on the inlet duct 41. In this opening 26 oblique blinds or baffles 44 are also provided to prevent the ingress of rain.

Figure 12:
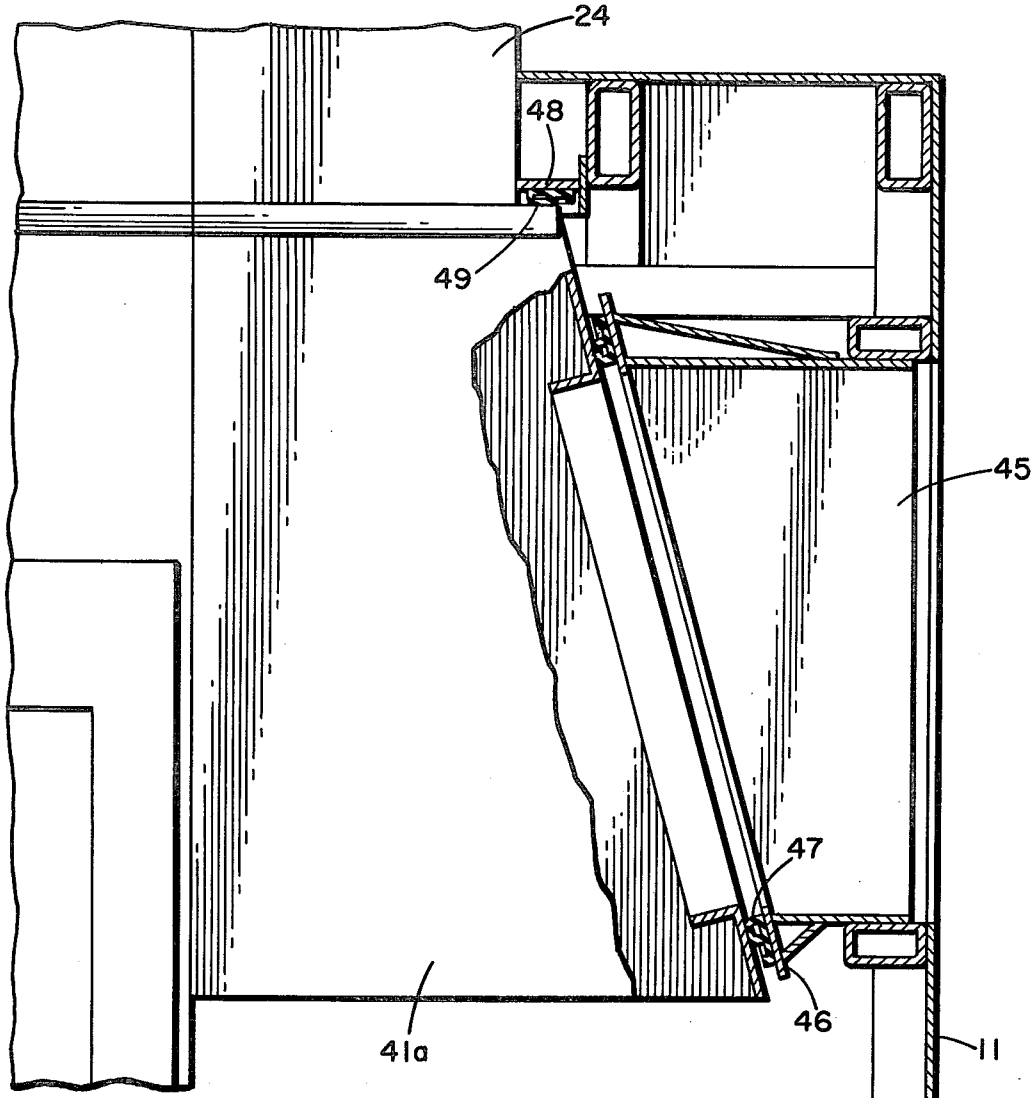
FIG. 12 is a sectional view showing the sealing of the hood 11 to the exhaust duct 24 and another cooling inlet duct 41*a*.

In FIG. 12 the sealing of another duct 41*a* leading to the cooling installation is shown. The inlet opening 45 is present in one end wall of the engine hood or enclosure 11 (for ventilation of the engine compartment) and is provided with a frame 46, which engages the duct 41*a* by means of a sealing ring 47, which lies in a plane extending obliquely upwardly and inwardly from the lower edge of the opening. Thus the closing surfaces 42,43 and 46,47 of both these air inlet openings are sealed obliquely, so that the engine hood or enclosure 11 can be lifted and lowered vertically without risk of obstruction.

FIG. 12 also shows the sealing of the engine hood or enclosure 11 to the exhaust duct 24 of the cooling installation duct 41*a*. This is achieved by means of a frame 48 mounted round all sides of the opening in the engine hood or enclosure 11, and an associated seal 49.

As mentioned, the engine hood or enclosure 11 is raised at the four corners by means of four screw-type jack mechanisms, driven by mutually synchronously running alternating-current motors, which may be connected to alternating-current mains in the workshop. Limit switches at each end of the spindles define the end positions during the lifting and lowering of the engine hood or enclosure.

In order to give the engine hood or enclosure sufficient stability and so that it can be robust and rigid, its frame is built of tubular profile members. The total weight can thus be kept relatively low. In the illustrated embodiment the engine hood or enclosure inclusive of its noise insulation and the sealing members has a weight of 3200 kg. Using two 380 volt alternating-current motors each of 1.5 kilowatts, the lifting time of the hood or enclosure is about 110 seconds. The lifting height is about 2 meters, which provides an unobstructed passage underneath for the maintenance personnel in the locomotive repair shop.

Daily and longer period maintenance of the illustrated locomotive is low, and searching for faults and the mechanical and electrical remedying of them is simple and can take only a little time. All levels of oil, fuel and water are indicated in the cabs, as are the oil pressure and the water temperature. The operator should only replenish fuel and water, via the inspection door 33 (FIG. 4) when the need for this is indicated in the cabs.

Noise measurements have shown that the illustrated locomotive can be called particularly silent. A level of 62 dB (A) at a distance of 40 meters has been measured. The factors contributing to this are:

- Entirely closed engine hood or enclosure, provided with extra noise insulating and muffling material;
- The main frame is completely closed on the underside;
- Extra capacity engine cooling system with a slow running ventilator, which can moreover be switched off for about 5 minutes (for example when running through residential areas);
- A specially designed exhaust muffler;
- Bogies and wheels suspended by rubber elements;
- Heavily constructed and box-shaped wheels, whereby the noise is considerably reduced;
- Gearing-boxes for the bogies equipped with precisely machined toothwheels.

The locomotive therefore entirely meets up-to-date requirements for noise control.

While the invention has been illustrated by a single embodiment, it will be understood that many variations and alternative embodiments are possible. It is intended to cover all these by the following claims.

What is claimed is:

1. A railway locomotive having at least one cab at one end thereof for an operator, an engine and associated apparatus intermediate the ends of said locomotive a unitary movable enclosure, rectantular in plan, having a roof, two side walls and two end walls enclosing and covering the said engine and associated apparatus, and power-operated lifting means comprising four vertical screw jacks positioned within the enclosure when enclosing said engine, and associated apparatus, two synchronized alternating-current motors and a common drive for each two of said jacks for lifting the said enclosure upwardly as a unit to provide access to the said engine and associated apparatus, two of said screw jacks being at each longitudinal end of the enclosure coupled by said common drive shaft extending along the short side of the enclosure, each said drive shaft being driven by said synchronized alternating-current motor, whereby when driven from a common suitable current supply, the two drive motors drive all four screw jacks at the same speed, the said side and end walls of the enclosure having sound-insulating material on their inner faces and the cab having a wall adjacent to and spaced from one of the said end walls of the enclosure in the closed position thereof.

2. A railway locomotive according to claim 1 having a platform, on which the said engine and the lifting means from the enclosure are mounted, the platform having sound-insulation beneath the engine and the enclosure having a resilient seal to seal it to the platform in its lowered position.

3. A railway locomotive according to claim 2 wherein the lifting means for the enclosure is adapted to exert an extra closing force on said resilient seal, additional to the weight of the enclosure, when the enclosure is in its lowered position.

4. A railway locomotive according to claim 1 wherein the enclosure has at least one opening for inlet or outlet of air for the engine, communicating with a fixed duct within the enclosure, the said duct and the enclosure being sealed to each other in the closed position of the enclosure, along a surface lying in a plane which extends inwardly and upwardly from the lower edge of the seal.

5. A railway locomotive according to claim 1 wherein the enclosure has an inspection door in at least one of its side walls.

6. A railway locomotive according to claim 1 having interlocking means to ensure that the lifting means for the enclosure cannot be operated while the locomotive is in motion.

7. A railway locomotive according to claim 1 having two of said cabs respectively adjacent each end of the locomotive with the said enclosure between them, each said cab having a wall adjacent to and spaced from the respective end wall of the enclosure.

* * * * *